US008798503B2

(12) United States Patent
Yamaguchi

(10) Patent No.: US 8,798,503 B2
(45) Date of Patent: Aug. 5, 2014

(54) BELT UNIT CONFIGURATION FOR AN IMAGE FORMING APPARATUS

(75) Inventor: Wataru Yamaguchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 851 days.

(21) Appl. No.: 12/892,033

(22) Filed: Sep. 28, 2010

(65) Prior Publication Data

US 2011/0158689 A1 Jun. 30, 2011

(30) Foreign Application Priority Data

Dec. 28, 2009 (JP) ..... 2009-298327

(51) Int. Cl.
*G03G 21/16* (2006.01)

(52) U.S. Cl.
USPC ..... 399/121

(58) Field of Classification Search
USPC ..... 399/121
See application file for complete search history.

(56) References Cited

U.S. PATENT DOCUMENTS

2007/0025762 A1* 2/2007 Kato et al. ..... 399/121

FOREIGN PATENT DOCUMENTS

| | | |
|---|---|---|
| JP | 2001013800 A | 1/2001 |
| JP | 2003-171030 | 6/2003 |
| JP | 2007-033807 | 2/2007 |
| JP | 2007-101728 | 4/2007 |

OTHER PUBLICATIONS

Notice of Reasons for Rejection for Japanese patent application No. 2009-298327 mailed Nov. 29, 2011.

* cited by examiner

*Primary Examiner* — Walter L Lindsay, Jr.
*Assistant Examiner* — Ruth Labombard
(74) *Attorney, Agent, or Firm* — Banner & Witcoff, Ltd.

(57) ABSTRACT

An image forming apparatus including an endless belt in a belt unit is disclosed. The image forming apparatus includes an engaging portion that contacts the belt unit such that the surface of the belt is placed under tension while the belt unit is urged against the engaging portion.

15 Claims, 7 Drawing Sheets

BELT UNIT CONFIGURATION FOR AN IMAGE FORMING APPARATUS

CROSS REFERENCE TO RELATED APPLICATION

This application claims priority from Japanese Patent Application No. 2009-298327, filed on Dec. 28, 2009, the entire subject matter of which is incorporated herein by reference.

FIELD

Aspects of the disclosure relate to an image forming apparatus.

BACKGROUND

A known image forming apparatus includes a belt unit attached to an apparatus body. For example, the apparatus body has a positioning hole and the belt unit has a positioning protrusion. The positioning protrusion of the belt unit is inserted into the positioning hole of the apparatus body, so that the belt unit is positioned with respect to the apparatus body.

SUMMARY

To facilitate the operation for attaching the belt unit to the apparatus body, a diameter of the positioning hole can be greater than that of the positioning protrusion.

However, if the diameter of the positioning hole is greater than that of the positioning protrusion, when the positioning protrusion is only inserted into the positioning hole, a certain amount of play between the positioning hole and the positioning protrusion occurs due to a difference in diameter size, and the belt unit may not be accurately positioned relative to the main body.

When the positioning protrusion is inserted into the positioning hole, an outer surface of the positioning protrusion can be brought into contact with an inner wall surface defining the positioning hole, such that the play between the belt unit and the main body can be eliminated.

Aspects of the disclosure may provide an image forming apparatus in which a belt unit can be accurately positioned relative to a main body of the image forming apparatus.

BRIEF DESCRIPTION OF THE DRAWINGS

Illustrative aspects will be described in detail with reference to the following figures in which like elements are labeled with like numbers and in which.

DETAILED DESCRIPTION

An illustrative embodiment of the disclosure will be described in detail with reference to the accompanying drawings. An image forming apparatus according to illustrative aspects of the disclosure is employed in a tandem-type image forming apparatus.

A first embodiment of the disclosure will be described.

The general structure of an illustrative image forming apparatus 1 will be described with reference to FIG. 1.

For ease of discussion, in the following description, the top or upper side, the bottom or lower side, the left or left side, the right or right side, the front or front side, and the rear or rear side of the image forming apparatus 1 will be identified as indicated by the arrows in FIG. 1. With regard to various individual objects of the image forming apparatus 1, sides of the individual objects will be similarly identified based on the arranged/attached position of the object on/in the image forming apparatus 1 shown in FIG. 1. The top and bottom direction may be referred to as a height direction, and the left and right direction may be referred to as a width direction.

Figure 1:
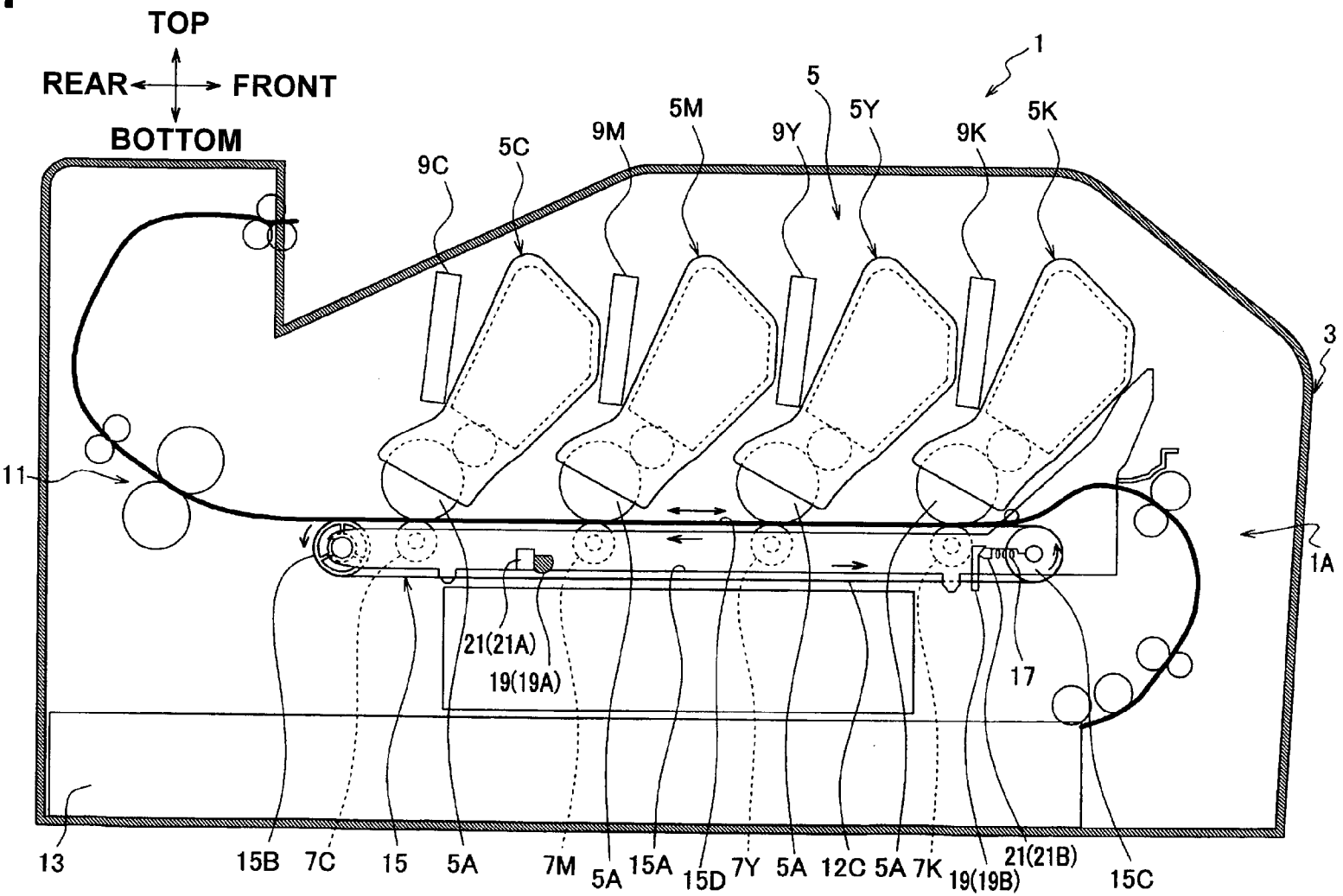
FIG. 1 is a central cross sectional view of an illustrative example of an image forming apparatus using features described herein.

As shown in FIG. 1, the image forming apparatus 1 includes a body casing 3 forming an external appearance of the image forming apparatus 1, an image forming unit 5 that is configured to form an image on a recording sheet, e.g., plain paper and a transparency sheet, (hereinafter referred to as a recording sheet) by transferring a developer image onto the recording sheet. The image forming unit 5 includes plural, e.g. four, process cartridges 5K, 5Y, 5M, 5C, transfer rollers 7K, 7Y, 7M, 7C, exposure devices 9K, 9Y, 9M, 9C, and a fixing unit 11.

The four process cartridges 5K, 5Y, 5M, 5C are arranged in line along a rotational direction of a transfer belt 15A or a sheet feeding direction in which a recording sheet is fed. In this illustrative embodiment, the process cartridges 5K, 5Y, 5M, and 5C respectively contain black developer, yellow developer, magenta developer, and cyan developer, and are arranged in this order from an upstream side in the sheet feeding direction.

Each of the process cartridges 5K, 5Y, 5M, 5C is detachably attached to an apparatus body 1A, and includes a photosensitive drum 5A that is configured to carry a developer image thereon. The apparatus body 1A means a frame (not shown), to which the image forming unit 5 is assembled, and the body casing 3.

The exposure devices 9K, 9Y, 9M, 9C are disposed at positions corresponding to the process cartridges 5K, 5Y, 5M, 5C. Each of the exposure devices 9K, 9Y, 9M, 9C is configured to expose the photosensitive drum 5A of a corresponding one of the process cartridges 5K, 5Y, 5M, 5C such that an electrostatic latent image is formed on a peripheral surface of the photosensitive drum 5A. In this illustrative embodiment, each of the exposure devices 9K, 9Y, 9M, 9C includes an LED array. The LED array includes plural light emitting diodes (LEDs) that are arranged in a direction parallel to an axial direction of its corresponding photosensitive drum 5A. Each of the exposure devices 9K, 9Y, 9M, 9C is configured to expose the photosensitive drum 13 by controlling flashing of LEDs.

The four transfer rollers 7K, 7Y, 7M, 7C are disposed at positions corresponding to the photosensitive drums 5A via the transfer belt 15A. The transfer rollers 7K, 7Y, 7M, 7C are configured to transfer the developer images carried on the photosensitive drums 5A onto a recording sheet fed by the transfer belt 15A. The fixing unit 11 is configured to fix developer images transferred onto the recording sheet by heat.

A sheet feed tray 13 is detachably disposed in a lower portion of the apparatus body 1A. The sheet supply tray 13 is configured to store a stack of sheets to be conveyed to the image forming unit 5.

A structure of a belt unit 15 will be described.

Figure 2:
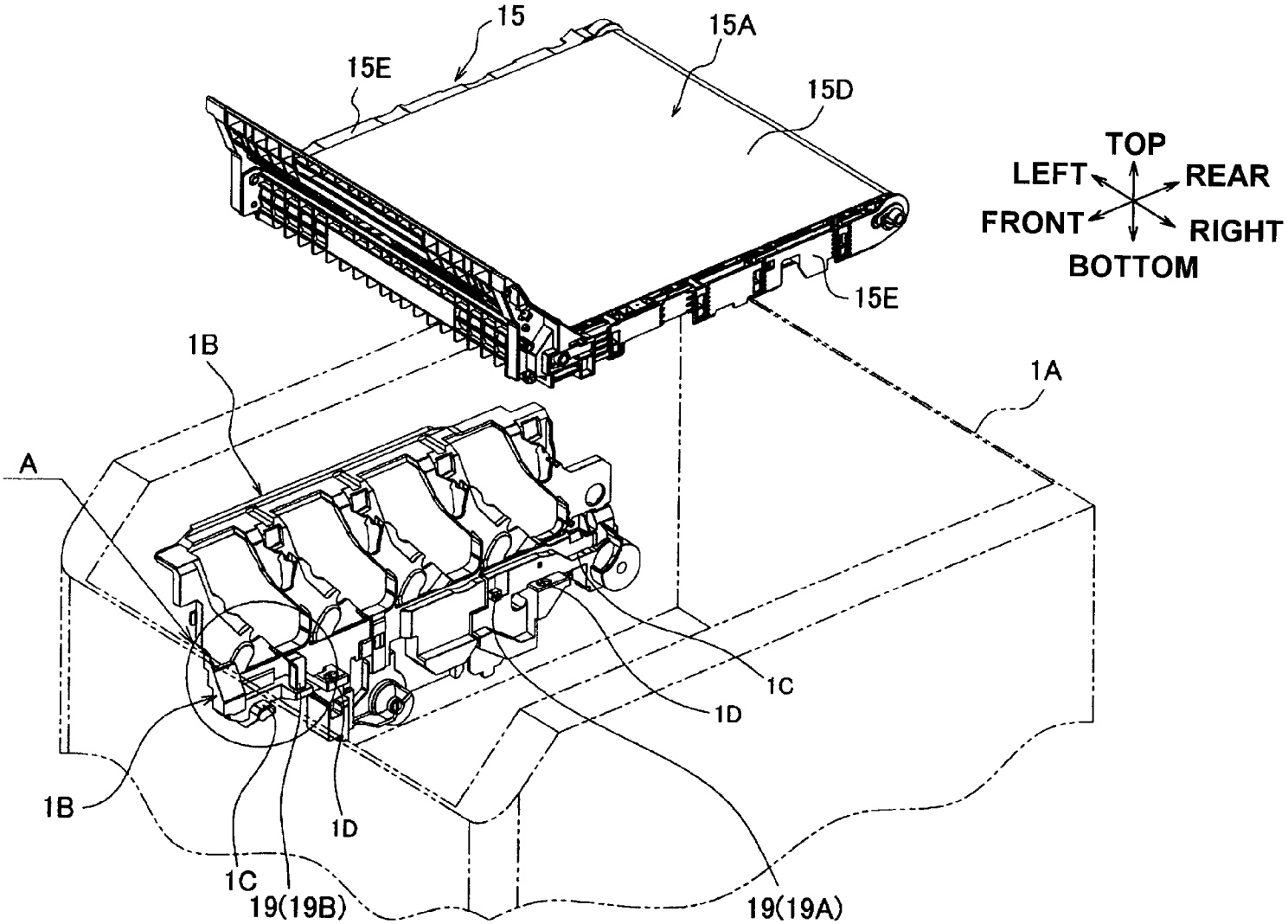
FIG. 2 is a perspective view of a belt unit, which is removed from an apparatus body of the image forming apparatus, according to illustrative aspects of the disclosure.

As shown in FIG. 1, the belt unit 15 is disposed between the image forming unit 5 and the sheet supply tray 13. The belt unit 15 can be configured to feed a recording sheet from the sheet supply tray 13 toward the fixing unit 11. As shown in FIG. 2, the belt unit 15 is detachably attached to the apparatus body 1A.

In this embodiment, the top portion of the body casing 3 is covered with an openable cover. When the cover is opened and the process cartridges 5K, 5Y, 5M, 5C are removed, the belt unit 15 can be removed from the apparatus body 1A.

The belt unit 15 includes a transfer belt 15A, a drive roller 15B and a driven roller 15C. The drive roller 15B is configured to rotate the transfer belt 15A responsive to a driving force transmitted from a drive unit (not shown) disposed in the apparatus body 1A. The driven roller 15C is rotated along with rotation of the transfer belt 15A.

The transfer belt 15A is an endless belt made of resin, e.g. thermoplastic elastomer in this illustrative embodiment, and extends between the drive roller 15B and the driven roller 15C. A recording sheet fed from the sheet supply tray 13 is fed to the transfer belt 15A. On the transfer belt 15A, the recording sheet is fed from the drive roller 15B side via a flat surface portion 15D to the driven roller 15C side. The flat surface portion 15D of the transfer belt 15A is a flat portion which extends between the drive roller 15B and the driven roller 15C and faces the process cartridges 5K, 5Y, 5M, 5C.

As the flat surface portion 15D is stretched by the drive roller 15B and the driven roller 15C, the flat surface portion 15D is flat and faces the process cartridges 5K, 5Y, 5M, 5C. The process cartridges 5K, 5Y, 5M, 5C are arranged in line along the rotational direction of the transfer belt 15A in the flat surface portion 15D.

The drive roller 15B and the driven roller 15C are supported by a pair of belt frames 15E, which are disposed on both longitudinal ends of the drive roller 15B and the driven roller 15C. As shown in FIG. 2, the belt frames 15E extend in a direction parallel to the rotational direction of the transfer belt 15A in the flat surface portion 15D (hereinafter referred to as an extending direction of the transfer belt 15A). The transfer rollers 7K, 7Y, 7M, 7C are assembled to the belt frames 15E.

The driven roller 15C is disposed such that its axial direction is parallel to the axial direction of the drive roller 15B, when it is viewed in a direction orthogonal to the flat surface portion 15D. In addition, the driven roller 15C is assembled to the belt frames 15E such that it is movable close to or away from the driven roller 15B.

Figure 3:
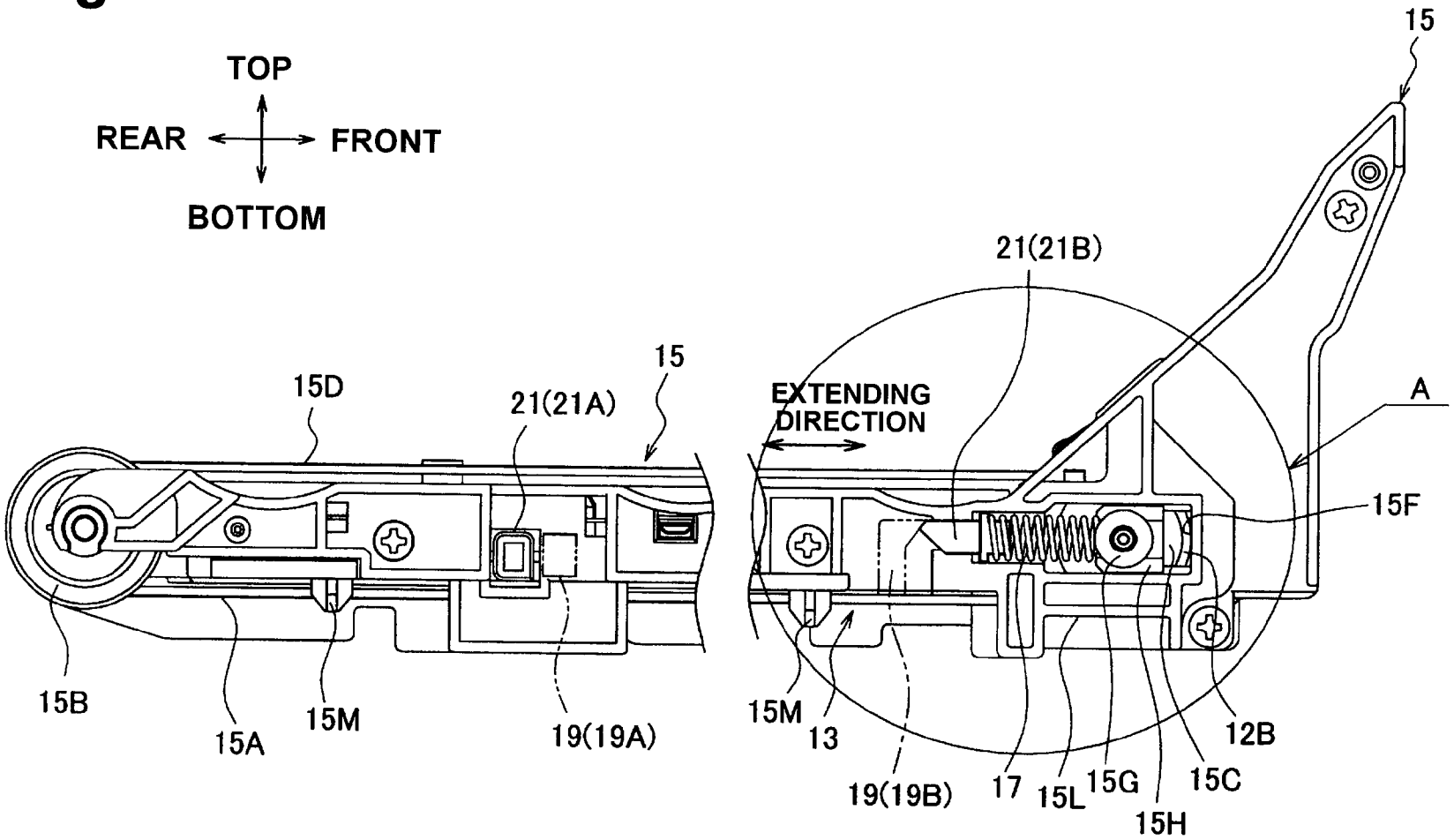
FIG. 3 is a side sectional view of the belt unit according to a first embodiment of the disclosure.

As shown in FIG. 3, each belt frame 15E is provided with a long hole 15F, which is rectangular shaped, at one longitudinal end thereof, e.g. at the front side in this embodiment. The long hole 15F is disposed such that its longitudinal direction coincides with the longitudinal direction of the corresponding belt frame 15E. A bearing block 15H is movably assembled in the long hole 15F. The bearing block 15H is configured to support a rotation shaft 15G of the driven roller 15C rotatably.

Figure 4:
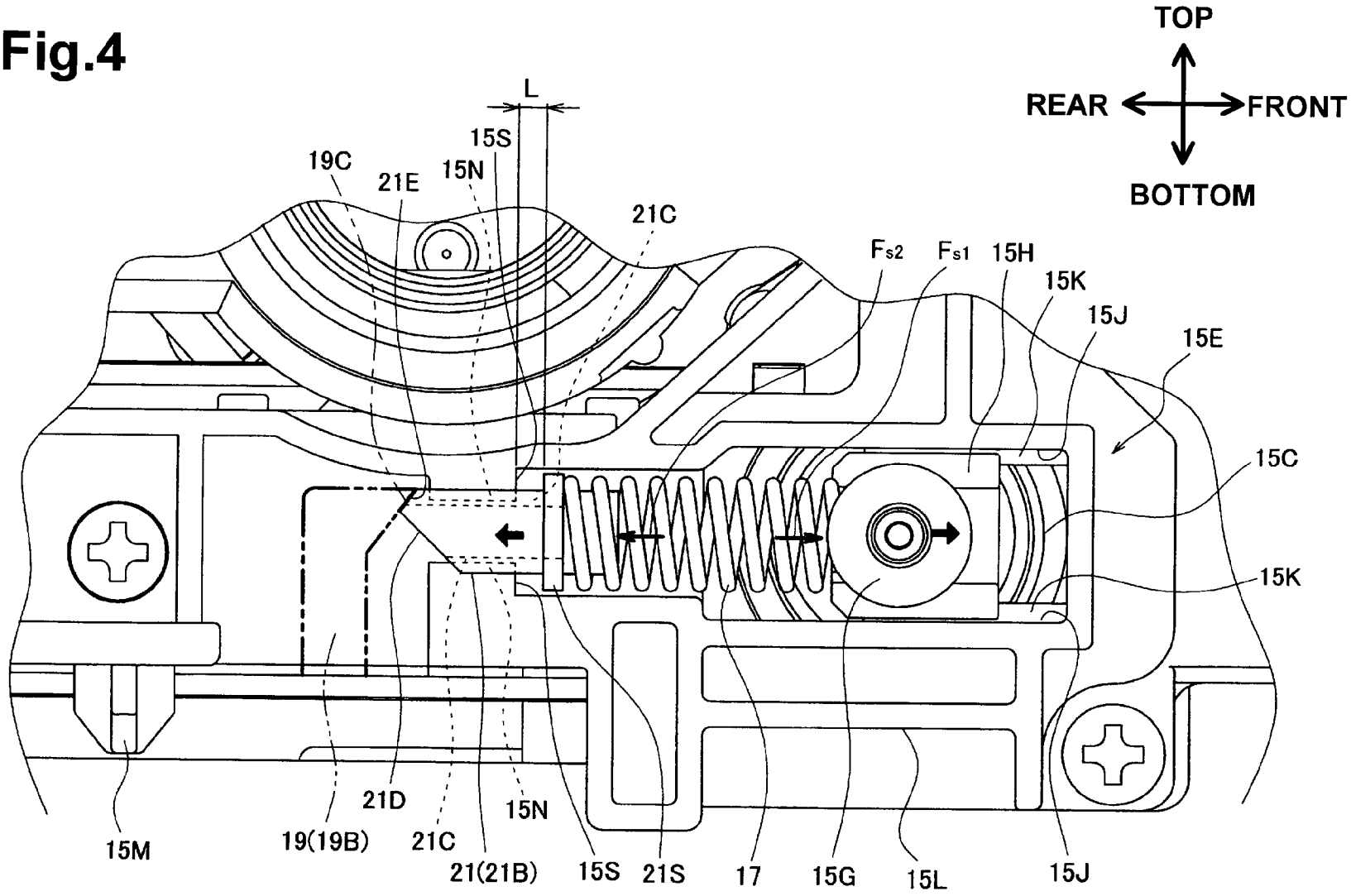
FIG. 4 is an enlarged view of an encircled portion of FIG. 3.

As shown in FIG. 4, the long hole 15F includes a pair of inner wall surfaces 15J, which extend in a direction parallel to the longitudinal direction of the belt frame 15E. The inner wall surfaces 15J are provided with ridge portions 15K respectively. The ridge portions 15K extend in the direction parallel to the longitudinal direction of the belt frame 15E. Although it is not shown, the bearing block 15H is provided with grooves which face the inner wall surfaces 15J and extend in the direction parallel to the longitudinal direction of the belt frame 15E.

As the ridge portions 15K are slidable in the grooves, the bearing block 15H is configured to move only in the direction parallel to the longitudinal direction of the belt frame 15E.

Each belt frame 15E is provided with a spring 17 that exerts an elastic force in the bearing block 15H. When the spring 17 is deformed under compression, the bearing block 15H receives an elastic force Fs1 that acts in a direction to increase a distance between the drive roller 15B and the driven roller 15C. The spring 17 is configured to urge, e.g. press, the driven roller 15C in a direction away from the drive roller 15B.

In this illustrative embodiment, the spring 17 is formed spirally or coiled around an axis and is configured to be compressed in its axial direction which is parallel to the direction in which the elastic force Fs1 acts and the longitudinal direction of the belt frame 15E. With this configuration, almost all of the elastic force of the spring 17 applied to the bearing block 15H acts on the bearing block 15H as the elastic force Fs1, and a direction of tension generated in the flat surface portion 15D coincides with the extending direction.

In this illustrative embodiment, the driven roller 15C functions as a tension roller that applies a predetermined tension to the transfer belt 15A as the driven roller 15C is configured to extend or stretch the transfer belt 15A in cooperation with the drive roller 15B. The transfer belt 15A is rotated together with the drive roller 15B by a frictional force generated in a contact portion between the transfer belt 15A and the drive roller 15B, without slipping against the drive roller 15B.

As shown in FIG. 3, one of the belt frames 15E, e.g. a left belt frame 15E in this embodiment, is provided with a frame-side engaging portion 21, which is configured to engage a body-side engaging portion 19 provided in the apparatus body 1A. The frame-side engaging portion 21 engages the body-side engaging portion 19, so that the position of the belt unit 15 in the apparatus body 1A at least in the extending direction is maintained.

The belt-side engaging portion 21 includes a fixed engaging portion 21A and a movable engaging portion 21B. The fixed engaging portion 21A is integrally formed with the left belt frame 15E. As shown in FIG. 4, the movable engaging portion 21B is configured to move only in a direction along the extending direction.

Specifically, the left belt frame 15E includes a pair of guide ridge portions 15N, which are disposed at positions corresponding to top and bottom sides of the movable engaging portion 21B. The guide ridge portions 15N are formed like rails which extend in a direction parallel to the extending direction, e.g. in a front-rear direction in FIG. 4. The movable engaging portion 21B includes a pair of guide grooves 21C at the top and bottom sides thereof. The guide grooves 21C extend in the direction parallel to the extending direction and are configured to receive the guide ridge portions 15N slidably. In other words, the guide ridge portions 15N are configured to fit in the guide grooves 21C and guide the movable engaging portion 21B in the direction parallel to the extending direction. Thus, the movable member 21B can be displaced only in the direction along the extending direction.

As shown in FIG. 4, the movable engaging portion 21B includes a spring washer 21S on a side close to the spring 17. The spring washer 21S is configured to receive an elastic force Fs2 from the spring 17. The elastic force Fs2 is arranged in a direction to urge the movable engaging portion 21B against the first body-side engaging portion 19B. Thus, the spring 17 is configured to urge the movable engaging portion 21B against the first body-side engaging portion 19B. The left belt frame 15E includes a stopper 15S. The stopper 15S is configured to receive the spring washer 21S and maintain the spring 17 deformed under compression such that the spring 17 continues to urge the rotational shaft 15G in a direction away from the drive roller 15B. When the belt unit 15 is removed from the apparatus body 1A, the movable engaging portion 21B disengages from the first body-side engaging portion 19B, the spring washer 21S collides with stopper 15S, and the spring 17 is maintained in a deformed state. Thus, the spring 17 does not extend to its natural length (which is a length of the spring 17 applied under no load).

As shown in FIG. 3, the body-side engaging portion 19 includes a second body-side engaging portion 19A and a first body-side engaging portion 19B. When the belt unit 15 is attached to the apparatus body 1A, the second body-side engaging portion 19A is configured to engage the fixed engaging portion 21A and the first body-side engaging portion 19B is configured to engage the movable engaging portion 21B. The first body-side engaging portion 19B and the second body-side engaging portion 19A are integrally formed with a frame 1B of the apparatus body 1A as shown in FIG. 2.

As shown in FIG. 4, the spring 17 is assembled to the left belt frame 15E such that it is sandwiched between the rotational shaft 15G of the driven roller 15C (or the bearing block 15H) and the movable engaging portion 21B in its compressed direction or axial direction.

Thus, the spring 17 applies oppositely-directed forces to the rotational shaft 15G and the movable engaging portion 21B in its axial direction in order to urge the rotational shaft 15G and the movable engaging portion 21B. Specifically, the spring 17 applies the elastic force Fs1 to the rotational shaft 15G on one end in the axial direction, e.g. on the front end in the front-rear direction. The spring 17 also applies the elastic force Fs2 to the movable engaging portion 21B on the other end in the axial direction, e.g. on the rear end in the front-rear direction. As the movable member 21B can be displaced only in the direction along the extending direction, the movable member 21B engages the first body-side engaging portion 19B, such that the belt unit 5 is maintained in position in the apparatus body 1A in the extending direction.

With this configuration, when the belt unit 15 is attached to the apparatus body 1A, the spring 17 is further compressed by a distance L shown in FIG. 4 compared with a state at which the belt unit 15 is removed from the apparatus body 1A. Thus, the spring washer 21S and the stopper 15S are spaced apart from each other, a predetermined tension is applied to the transfer belt 15A, and the body-side engaging portion 19 and the belt-side engaging portion 21 engage each other under the elastic force Fs2 having the direction to increase a contact surface pressure between the body-side engaging portion 19 and the belt-side engaging portion 21.

In this illustrative embodiment, as shown in FIG. 2, the belt unit 15 is attached to the apparatus body 1A by moving the belt unit 15 downward from an opening of the apparatus body 1A.

At this time, the belt unit 15 may be moved horizontally and downward into the apparatus body 1A or the drive roller 15B side of the belt unit 15 may be inclined lower than the driven roller 15C side such that the drive roller 15B side may be first attached to the apparatus body 1A.

When the belt unit 15 is inclined when attached to the apparatus body 1A, the drive roller 15B side is first attached to the apparatus body 1A, and then the driven roller 15C side is rotated downward (about the drive roller 15B side) relative to the apparatus body 1A.

In this illustrative embodiment, as described above, when the belt unit 15 is removed from the apparatus body 1A, the spring washer 21S of the movable engaging portion 21B collides with the stopper 15S of the left belt frame 15E, thereby reducing a chance of the spring 17 from extending to its natural length. Thus, even when the belt unit 15 is removed from the apparatus body 1A and the first body-side engaging portion 19B disengages from the movable engaging portion 21B, the spring 17 remains in a deformed state under compression.

The body-side engaging portion 19 and the belt-side engaging portion 21 are disposed such that, when the belt unit 15 is attached to the apparatus body 1A and the movable engaging portion 21B engages the first body-side engaging portion 19B, the spring washer 21S is spaced apart from the stopper 15S and the spring 17 is compressed more than that when the movable engaging portion 21B disengages from the first body-side engaging portion 19B.

The movable engaging portion 21B is formed with a first inclined surface 21D and a second inclined surface 21E on a side facing the first body-side engaging portion 19B. The first and second inclined surfaces 21D, 21E are inclined in a direction in which the belt unit 15 is attached, e.g. vertical direction, and a direction in which the movable engaging portion 21B is spaced apart from the first body-side engaging portion 19B, e.g. the extending direction or the direction in which the spring 17 is compressed.

Figure 5:
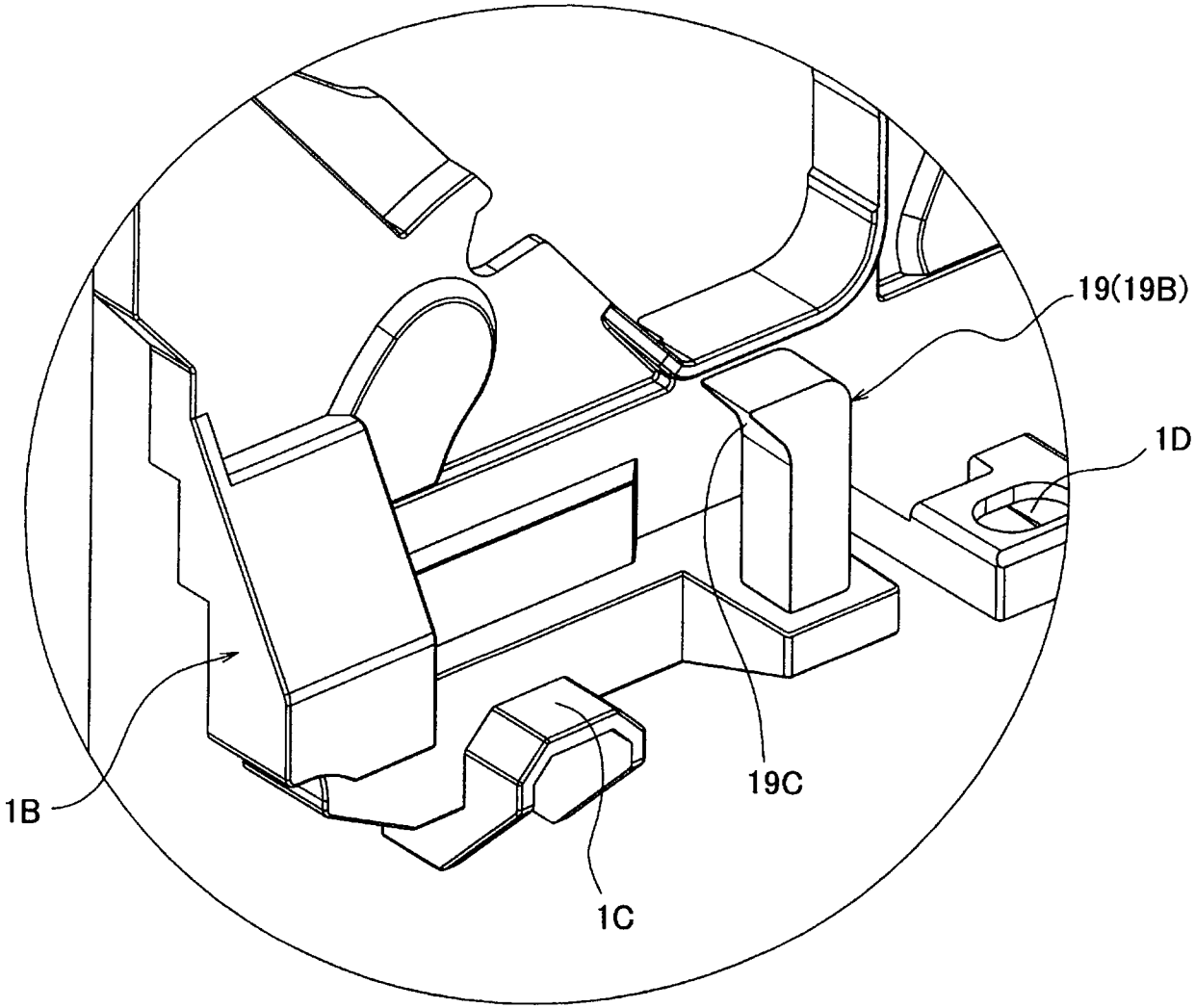
FIG. 5 is an enlarged view of an encircled portion of FIG. 2.

As shown in FIG. 5, the first body-side engaging portion 19B is formed like a hook protruding from the frame 1B toward the belt unit 15 (e.g. protruding upward in this embodiment) to have an inclined surface 19C, which is generally parallel to the second inclined surface 21E of the movable engaging portion 21B. Thus, when the belt unit 15 is attached to or removed from the apparatus body 1A, a force to deform the spring 17 under compression is produced.

Operation of the movable engaging portion 21B will be described.

Figure 6B:
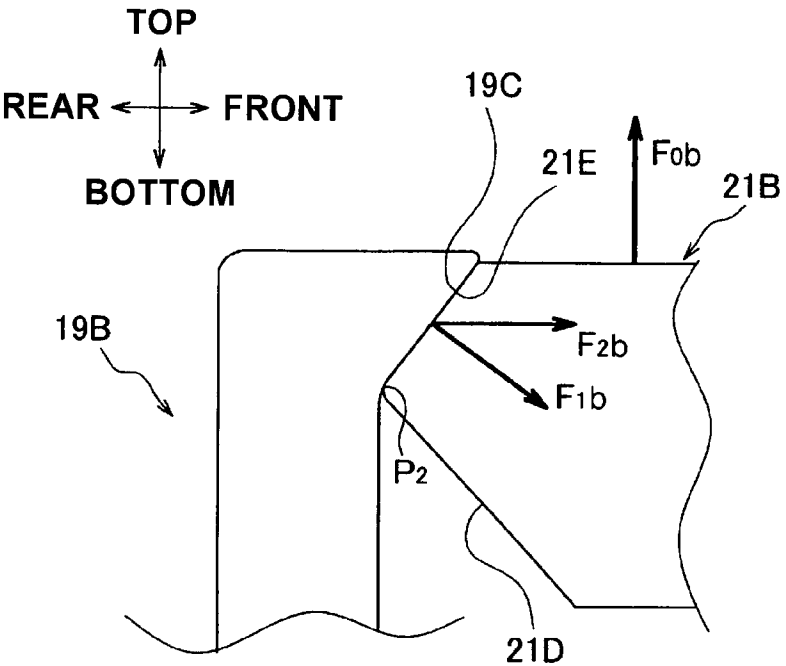
FIG. 6B illustrates directions of forces generated between the movable engaging portion and the first body-side engaging portion when the engagement of the movable engaging portion with the first body-side engaging portion is being released.
Figure 6A:
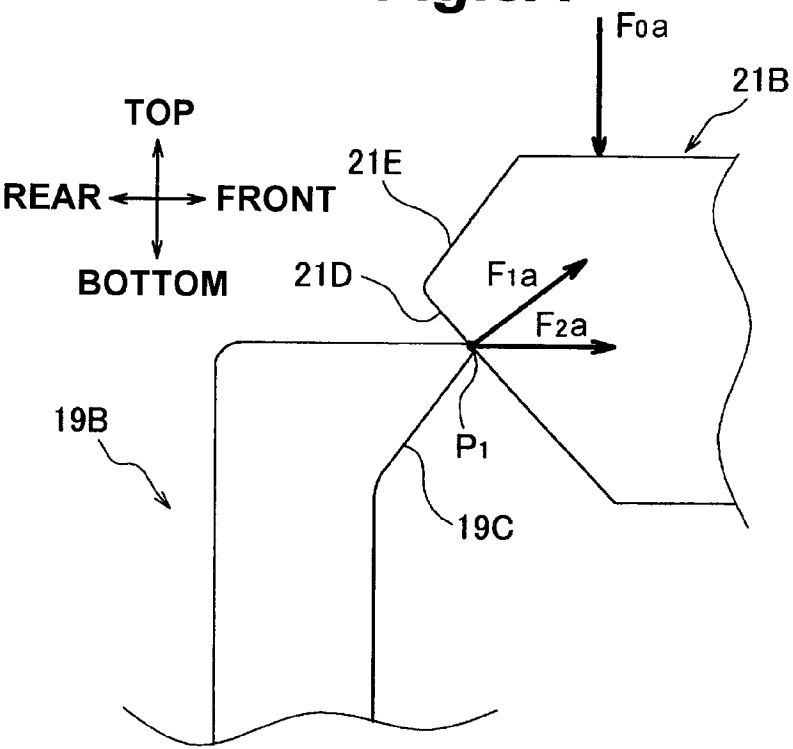
FIG. 6A illustrates directions of forces generated between a movable engaging portion and a first body-side engaging portion when the movable engaging portion is engaging the first body-side engaging portion.

The movable engaging portion 21B is provided with the first inclined surface 21D. As shown in FIG. 6A, when the belt unit 15 is being attached to the apparatus body 1A, a force F0*a* for attaching the belt unit 15 to the apparatus body 1A is produced, and the first inclined surface 21D is subjected to a force F1*a*. The force F1*a* is a force that a contact portion P1 of the first body-side engaging portion 19B presses the first inclined surface 21D. At this time, a force F2*a* that is a component force of the force F1*a* acts. The force F2*a* is a force having a direction to separate the movable engaging portion 21B from the first body-side engaging portion 19B or a direction to move the movable engaging portion 21B toward the spring 17.

Thus, while the spring 17 is further compressed, the contact portion P1 moves toward the second inclined surface 21E. When the contact portion P1 reaches the second inclined surface 21E, the force F2*a* disappears, the second inclined surface 21E contacts the inclined surface 19C of the first body-side engaging portion 19B, the spring washer 21S is spaced apart from the stopper 15S (FIG. 4), and the movable engaging portion 21B engages the first body-side engaging portion 19B.

In FIG. 6A, the force F1*a* is a force having a direction perpendicular to the first inclined surface 21D, and the force F2*a* is a component force having a direction in which the spring 17 is compressed.

The movable engaging portion 21B is provided with the second inclined surface 21E. As shown in FIG. 6B, when the belt unit 15 is removed from the apparatus body 1A, a force F0*b* for removing the belt unit 15 from the apparatus body 1A is produced, and the second inclined surface 21E is subjected to a force F1*b*. The force F1*b* is a force that the inclined surface 19C presses the second inclined surface 21E. At this time, a force F2*b* that is a component force of the force F1*b* acts. The force F2*b* is a force having a direction to separate the movable engaging portion 21B from the first body-side engaging portion 19B or a direction to move the movable engaging portion 21B toward the spring 17.

Thus, while the spring 17 is further compressed, the apex P2 of the movable engaging portion 21B moves along the inclined surface 19C. Finally the engagement of the movable engaging portion 21B with the first body-side engaging portion 19B is released and the spring washer 21S contacts the stopper 15S. As the spring 17 extends by the distance L (FIG. 4) when compared with a case in which the belt unit 15 is attached to the apparatus body 1A, the elastic force Fs1 that the spring 17 exerts on the driven roller 15C becomes smaller.

In FIG. 6B, the force F1*b* is a force having a direction perpendicular to the second inclined surface 21E. The force F2*b* is a component force having a direction in which the spring 17 is compressed.

In this illustrative embodiment, the elastic force Fs1 that the spring 17 exerts on the driven roller 15C when the belt unit 15 is attached to the apparatus body 1A is greater in magnitude than the elastic force Fs1 that the spring 17 exerts on the driven roller 15C when the belt unit 15 is removed from the apparatus body 1A. Thus, the movable engaging portion 21B is structured such that a dimension of the first inclined surface 21D along the inclined direction is greater than a dimension of the second inclined surface 21E along its inclined direction.

In this illustrative embodiment, the first inclined surface 21D, the second inclined surface 21E and the inclined surface 19C are parallel to each other in the width direction of the image forming apparatus 1. However, the first inclined surface 21D, the second inclined surface 21E and the inclined surface 19C may not be parallel to each other in the width direction as long as they are parallel to each other when viewed from a direction in which the belt unit 15 is attached or removed or a direction perpendicular to the flat surface portion 15D. The width direction of the image forming apparatus 1 coincides with a direction that is parallel to the flat surface portion 15D and perpendicular to the extending direction.

Positioning of the belt unit 15 with respect to the apparatus body 1A will be described.

When the belt unit 15 is placed in the apparatus body 1A, as shown in FIG. 3, the fixed engaging portion 21A engages the second body-side engaging portion 19A on the side opposite from the movable engaging portion 21B, and the movable engaging portion 21B engages the first body-side engaging portion 19B on the side opposite from the fixed engaging portion 21A. Under this condition, the movable engaging portion 21B is pressed against the first body-side engaging portion 19B by the elastic force Fs2 of the spring 17.

The driven roller 15C is urged, e.g., pressed, in the direction away from the drive roller 15B by the elastic force Fs1 which is the reaction force of the elastic force Fs2. Thus, the drive roller 15B receives a force with which the drive roller 15B is pulled toward the second body-side engaging portion 19A via the transfer belt 15A. Hereinafter, the force is referred to as a drive roller displacing force.

As the drive roller 15B is not able to move with respect to the belt frames 15E at this time, the drive roller displacing force is transmitted to the fixed engaging portion 21A via the belt unit 15, and received by the second body-side engaging portion 19A.

Thus, the elastic force Fs2 of the spring 17 acts on the belt 15 as a force that increases a contact surface pressure between the fixed engaging portion 21A and the second body-side engaging portion 19A and a contact surface pressure between the movable engaging portion 21B and the first body-side engaging portion 19B. As a result, the position of the belt unit 15 is maintained in the extending direction.

The frame 1B is provided with at least two gravity load bearing portions 1C (FIGS. 2 and 5) that are configured to bear the gravity load on the belt unit 15. The belt frame 15E is provided with contact portions 15L (only one shown in FIG. 4) that configured to contact the gravity load bearing portions 1C.

As the gravity load bearing portion 1C contacts the contact portion 15L, the position of the belt unit 15 is maintained vertically. The gravity load bearing portions 1C are provided on both frames 1B facing each other in the width direction, and the contact portions 15L are also provided on both belt frames 15E and disposed at positions corresponding to the gravity load bearing portions 1C.

As shown in FIG. 3, the left belt frame 15E is provided with at least two protrusions 15M which protrude vertically, e.g., downward in this illustrative embodiment. The protrusions 15M are inserted into long holes 1D (FIG. 2) provided in the frame 1B, and the belt unit 15 is wholly pressed toward the left belt frame 15E by an urging member, e.g. a spring, which is not shown. Thus, the position of the belt unit 15 is determined and maintained in the width direction.

The long holes 1D are formed such that their major diameters extend in the extending direction and their minor diameters extend in the width direction. Engagement between the protrusions 15M and the long holes 1D does not impair positioning in the extending direction. The urging member to urge the belt unit 15 in the width direction is disposed on a side of the apparatus body 1A to face the right belt frame 15E when the belt unit 15 is attached to the apparatus body 1A.

When the belt unit 15 is attached to the apparatus body 1A, the belt-side engaging portion 21 engages the body-side engaging portion 19 by receiving, from the spring 17, the elastic force having the direction to increase the contact surface pressure between the belt-side engaging portion 21 and the body-side engaging portion 19. Thus, the belt unit 15 is reliably attached to the apparatus body 1A without play of the belt unit 15 in the apparatus body 1A. Thus, the image forming apparatus 1 capable of reliably positioning the belt unit 15 in the apparatus body 1A can be obtained.

In this illustrative embodiment, the spring 17 for applying tension to the transfer belt 15A is used to eliminate play of the belt unit 15 with respect to the apparatus body 1A. Thus, there is no need to provide a spring or other device designed only to eliminate play of the belt unit 15 with respect to the apparatus body 1A, and the image forming apparatus 1 can be manufactured in a simplified structure with a reduced number of parts.

The spring 17 according to this embodiment is provided with the function to produce tension in the transfer belt 15A and the function to eliminate play of the belt unit 15 with respect to the apparatus body 1A. If a spring having functions similar to the spring 17 is disposed in the apparatus body 1A, the tension of the transfer belt 15A may disappear when the belt unit 15 is removed from the apparatus body 1A. As a result, the transfer belt 15A may be loosened, moved from its normal position and undesirably slipped off from the belt frames 15E.

If such a spring is disposed in the apparatus body 1A, there is a necessity to provide an additional structure to apply tension to the transfer belt 15A. This case may result in the complicated structure of the image forming apparatus and the need to increase the physical size of the image forming apparatus.

However, in this embodiment, the spring 17 is stored in the belt unit 15, and there is no need to provide the apparatus body 1 with a structure to apply tension to the transfer belt 15A. Thus, complexity in structure of the image forming apparatus 1 can be reduced and the need for increasing the size of the image forming apparatus 1 can be reduced.

In this embodiment, the elastic force of the spring 17 acts on the movable engaging portion 21B. The belt unit 15 is positioned with respect to the apparatus body 1A with reference to the engagement position between the second body-side engaging portion 19A and the fixed engaging portion 21A. The elastic force exerted on the movable engaging portion 21B can eliminate play of the belt unit 15, and reliably maintain the belt unit 15 in place in the apparatus body 1A. Thus, the belt unit 15 can be reliably positioned with respect to the apparatus body 1A.

In the image forming apparatus 1 including the belt unit 15, it is the most important to position the belt unit 15 in the direction parallel to the tension applied to the flat surface portion 15D of the transfer belt 15A, which faces the process cartridges 5K, 5Y, 5M, 5C for high-quality image formation.

In this embodiment, the belt-side engaging portion 21 engages the body-side engaging portion 19, thereby the position of the belt unit 15 in the apparatus body 1A is maintained at least in the extending direction. Thus, the image forming apparatus 1 can perform high-quality image formation.

In this embodiment, the spring 17 is a coiled spring, and is disposed such that its axis is parallel to the extending direction. When compressed, the spring 17 exerts the elastic force on the movable engaging portion 21B at one end in its axial direction, and exerts the elastic force on the driven roller 15C at the other end. With a simple structure, the image forming apparatus 1 can obtain the function to produce tension and the function to eliminate play.

In this embodiment, the belt frame 15E is provided with the guide ridge portions 15N which are configured to guide the movable engaging portion 21B in the direction parallel to the extending direction. The movable engaging portion 21B can be moved reliably.

As an alternative, the elastic force of the spring 17 may be exerted on the movable engaging portion 21B using a lever, e.g. an oscillating arm. However, in this structure, a great bending moment is normally exerted on the lever. Especially when the lever is made of resin, it is prone to creep deformation or permanent deformation developing with time under a fixed stress.

However, in this embodiment, the direction in which the movable engaging portion 21B is moved coincides with the direction of the elastic force of the spring 17, and the movable engaging portion 21B is structurally resistant to a great bending moment. Thus, creep deformation can be minimized and the durability of the image forming apparatus 1 can be improved.

In this embodiment, the movable engaging portion 21B is provided with the first inclined surface 21D. When the belt unit 15 is being attached to the apparatus body 1A, the force F0*a* is produced, and the first inclined surface 21D is subjected to the force F2*a* having the direction to separate the movable engaging portion 21B from the first body-side engaging portion 19B.

In this embodiment, while the belt unit 15 is attached to the apparatus body 1A, the first inclined surface 21D allows the movable engaging portion 21B to be automatically moved in the direction away from the first body-side engaging portion 19B. Thus, the belt unit 15 can be easily attached to the apparatus body 1A.

Similarly, the movable engaging portion 21B is provided with the second inclined surface 21E. When the belt unit 15 is removed from the apparatus body 1A, the force F0*b* is produced, and the second inclined surface 21E is subjected to the force F2*b* having the direction to separate the movable engaging portion 21B from the first body-side engaging portion 19B.

In this embodiment, while the belt unit 15 is removed from the apparatus body 1A, the second inclined surface 21E allows the movable engaging portion 21B to be automatically moved in the direction away from the first body-side engaging portion 19B. Thus, the belt unit 15 can be easily removed from the apparatus body 1A.

When the image forming apparatus 1 is moved, e.g., shipped from the manufacturer to the sales floor, the image forming apparatus 1 is packaged in a box (not shown) with the belt unit 15 being detached from the apparatus body 1A. If the flat surface portion 15D is exposed to a great tension over a prolonged period, the transfer belt 15A may have a bend in a contact portion in which the transfer belt 15A contacts the drive roller 15B or the driven roller 15C.

If the image formation is performed using the transfer belt 15A having such a bend, a distance between each process cartridge 5K, 5Y, 5M, 5C and the flat surface portion 15D may vary during rotation of the transfer belt 15A, which may result in deteriorated image quality.

In this embodiment, the spring 17 is configured such that the deformation amount of the spring 17 when the movable engaging portion 21B engages the first body-side engaging portion 19B is greater than that when the movable engaging portion 21B disengages from the first body-side engaging portion 19B.

With this configuration, the tension produced in the flat surface portion 15D is smaller when the belt unit 15 is removed from the apparatus body 1A than when the belt unit 15 is attached to the apparatus body 1A. Thus, a chance of a bend occurring in the transfer belt 15A may be reduced.

If the tension produced in the flat surface portion 15D is excessively small, the transfer belt 15A may be slipped out of position during movement, e.g., transportation, of the image forming apparatus 1. However, in this embodiment, even when the movable engaging portion 21B disengages from the first body-side engaging portion 19B, the spring 17 remains in a deformed state. Thus, the chance of the tension to be produced in the flat surface portion 15D becoming excessively small may be reduced, and the chance of the transfer belt 15A loosening may be reduced.

As described above, in this embodiment, high-quality image may be formed and the chance of the transfer belt 15A slipping out of position during movement of the image forming apparatus 1 may be reduced.

A second illustrative embodiment will be described.

Figure 7:
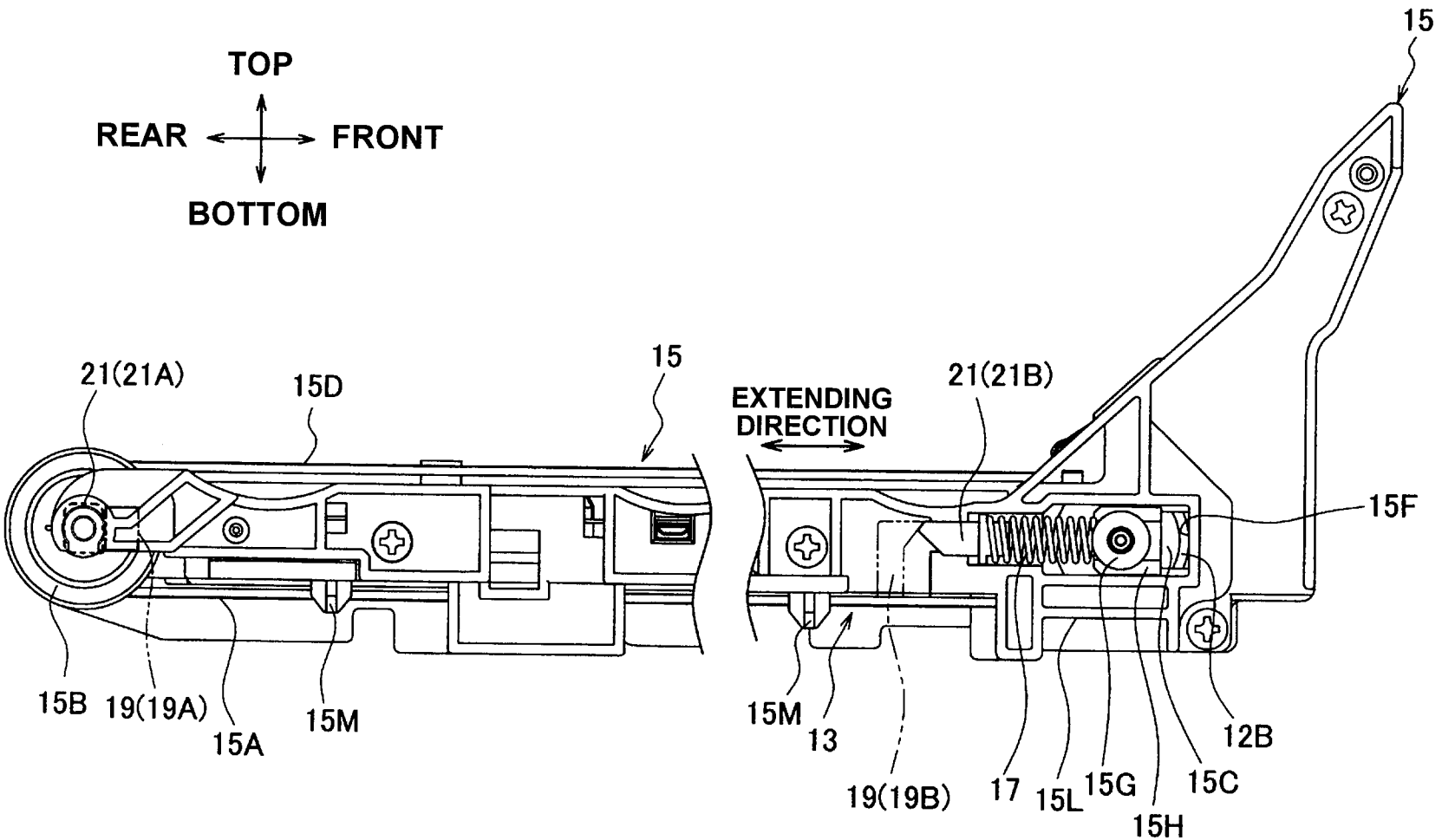
FIG. 7 is a side sectional view of a belt unit according to a second embodiment of the disclosure.

Although the first embodiment shows that the fixed engaging portion 21A is disposed at the belt frame 15E in the belt unit 15, the second embodiment shows that the fixed engaging portion 21A is disposed at an end of a rotational shaft of the drive roller 15B as shown in FIG. 7.

The illustrative embodiment shows, but the disclosure is not limited to, the belt-side engaging portion 21 is disposed at one belt frame 15E of the pair of the belt frames 15E. The belt-side engaging portion 21 may be disposed at each belt frame 15E.

The above illustrative embodiment shows, but the disclosure is not limited to, that the spring 17 is deformed under compression thereby exerting the elastic force on the movable engaging portion 21B. The spring 17 may be deformed by stretching thereby exerting the elastic force on the movable engaging portion 21B. In this case, a link or cable may be used to change the direction of the elastic force of the spring 17. Alternatively, the spring 17 may be disposed closer to the second body-side engaging portion 19A than the first body-side engaging portion 19B such as to press the movable engaging portion 21B toward the first body-side engaging portion 19B.

The illustrative embodiment shows, but the disclosure is not limited to, the coil spring. Instead, other types of spring, e.g., a leaf spring and a torsion spring, may be used.

The illustrative embodiment shows, but the disclosure is not limited to, that the belt unit 15 includes the drive roller 15B and the driven roller 15C which serves as a tension roller. The belt unit 15 may include a tension roller as well as the drive roller 15B and the driven roller 15C. In this case, the drive roller 15B and the driven roller 15C may be unable to move with respect to the belt frame 15E such that the elastic force of the spring 17 may be applied to the tension roller to apply tension to the transfer belt 15A. However, the elastic force may be transmitted to the movable engaging portion 21B through the use of a link or cable.

The illustrative embodiment shows, but the disclosure is not limited to, the exposure devices using LED arrays. Instead, a laser scanner that emits laser beams may be used.

The illustrative embodiment shows, but the disclosure is not limited to, a direct tandem type image forming apparatus. Instead, the image forming apparatus may be of an intermediate transfer type. In the intermediate transfer type, an intermediate belt may correspond to the endless belt.

The illustrative embodiment shows, but the disclosure is not limited to, that the direction of the spring 17 that is deformed, the direction of the movable engaging portion 21B that moves, and the extending direction coincide with each other. The direction of the spring 17 that is deformed, the direction of the movable engaging portion 21B, and the extending direction may be different. In this case, a link and a cable may be used to change the direction of the elastic force.

The illustrative embodiment shows, but the disclosure is not limited to, that the movable engaging portion 21B is moved only in the direction along the extending direction. The movable engaging portion 21B may be moved in any direction as long as the transfer belt 15A is extendable. For example, the movable engaging portion 21B may be moved in a direction orthogonal to the rotational shaft 15G of the driven roller 15C.

The illustrative embodiment shows, but the disclosure is not limited to, that, even when the belt unit 15 is removed from the apparatus body 1A, the spring 17 is deformed under compression to apply tension to the transfer belt 15A. When the belt unit 15 is removed from the apparatus body 1A, the spring 17 may not be deformed under compression.

While the features herein have been described in connection with various example structures and illustrative aspects, it will be understood by those skilled in the art that other variations and modifications of the structures and aspects described above may be made without departing from the scope of the disclosure described herein. Other structures and aspects will be apparent to those skilled in the art from a consideration of the specification or practice of the features disclosed herein. It is intended that the specification and the described examples only are illustrative with the scope of the inventions being defined by the following claims.

What is claimed is:

1. An image forming apparatus comprising:

an apparatus body including a first body-side engaging portion;

an image formation unit configured to form an image on a recording sheet; and a belt unit including:

a belt frame;

a pair of rollers supported by the belt frame;

an endless belt extending between the rollers, the rollers being spaced apart in a belt extending direction;

a first belt-side engaging portion configured to engage the first body-side engaging portion; and an elastic member configured to urge one of the rollers in a direction away from the other one of the rollers to apply a tension to the endless belt and to urge the first belt-side engaging portion against the first body-side engaging portion in a specified direction away from the one of the rollers, wherein the first belt-side engaging portion includes a first guide surface, and wherein, as the first belt-side engaging portion engages the first body-side engaging portion, the first body-side engaging portion presses the first guide surface such that the first belt-side engaging portion moves toward the elastic member.

2. The image forming apparatus according to 1, wherein the first guide surface is inclined with respect to the belt extending direction.

3. An image forming apparatus comprising:

an apparatus body including a first body-side engaging portion;

an image formation unit configured to form an image on a recording sheet; and a belt unit including:

a belt frame;

a pair of rollers supported by the belt frame;

an endless belt extending between the rollers, the rollers being spaced apart in a belt extending direction;

a first belt-side engaging portion configured to engage the first body-side engaging portion; and an elastic member configured to urge one of the rollers in a direction away from the other one of the rollers to apply a tension to the endless belt and to urge the first belt-side engaging portion against the first body-side engaging portion in a specified direction away from the one of the rollers, wherein the first belt-side engaging portion includes a second guide surface, and wherein as the first belt-side engaging portion disengages from the first body-side engaging portion, the first body-side engaging portion presses the second guide surface such that the first belt-side engaging portion moves toward the elastic member.

4. An image forming apparatus comprising:

an apparatus body including a first body-side engaging portion;

an image formation unit configured to form an image on a recording sheet; and a belt unit including:

a belt frame;

a pair of rollers supported by the belt frame;

an endless belt extending between the rollers, the rollers being spaced apart in a belt extending direction;

a first belt-side engaging portion configured to engage the first body-side engaging portion; and an elastic member configured to urge one of the rollers in a direction away from the other one of the rollers to apply a tension to the endless belt and to urge the first belt-side engaging portion against the first body-side engaging portion in a specified direction away from the one of the rollers, wherein, when the first belt-side engaging portion disengages from the first body-side engaging portion, the elastic member continues to urge the one of the rollers such that the tension is applied to the endless belt.

5. The image forming apparatus according to claim 4, wherein the apparatus body includes a second body-side engaging portion, and the belt unit includes a second belt-side engaging portion configured to engage the second body-side engaging portion.

6. The image forming apparatus according to claim 5, wherein the rollers include a drive roller that is configured to rotate the endless belt and a driven roller that is configured to be rotated along with rotation of the endless belt, and the second belt-side engaging portion is disposed on a shaft of the drive roller.

7. The image forming apparatus according to claim 4, wherein the first belt-side engaging portion is configured to engage the first body-side engaging portion such that the belt unit is maintained in position in the apparatus body in the belt extending direction.

8. The image forming apparatus according to claim 4, wherein the elastic member includes a spring that is formed spirally around an axis thereof, wherein the axis is parallel to the extending direction.

9. The image forming apparatus according to claim 8, wherein the spring is configured to press the first belt-side engaging portion at one end in the axial direction and to press the one of the rollers at another end in an axial direction of the axis.

10. The image forming apparatus according to claim 4, wherein the belt frame includes a guide portion that is configured to guide the first belt-side engaging portion in a direction parallel to the extending direction such that the first belt-side engaging portion is displaced.

11. The image forming apparatus according to claim 4, wherein the belt unit includes a stopper, and the stopper is configured to receive the elastic member and to maintain the elastic member in a deformed state when the first belt-side engaging portion disengages from the first body-side engaging portion.

12. The image forming apparatus according to claim 11, wherein an amount of deformation of the elastic member when the first belt-side engaging portion engages the first body-side engaging portion is greater than an amount of deformation of the elastic member when the first belt-side engaging portion disengages from the first body-side engaging portion.

13. The image forming apparatus according to claim 4, wherein the rollers include a drive roller that is configured to rotate the endless belt and a driven roller that is configured to be rotated along with rotation of the endless belt, and the elastic member is configured to urge the driven roller in a direction away from the drive roller.

14. The image forming apparatus according to claim 4, wherein the endless belt includes an extending portion facing the image formation unit and extending in the belt extending direction, the image formation unit includes a plurality of image formation cartridges, and the image formation cartridges are disposed facing the extending portion of the endless belt and arranged in tandem in the belt extending direction.

15. The image forming apparatus according to claim 4, wherein the belt unit is configured to transfer the recording sheet placed on the endless belt.

* * * * *